US011408715B2

(12) United States Patent
Pinoteau

(10) Patent No.: US 11,408,715 B2
(45) Date of Patent: Aug. 9, 2022

(54) PROJECTILE WITH DEPLOYABLE AIRFOIL SECTIONS

(71) Applicant: NEXTER MUNITIONS, Versailles (FR)

(72) Inventor: Sylvain Pinoteau, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 288 days.

(21) Appl. No.: 16/708,827

(22) Filed: Dec. 10, 2019

(65) Prior Publication Data

US 2020/0240757 A1 Jul. 30, 2020

(30) Foreign Application Priority Data

Dec. 10, 2018 (FR) ..... 1872570

(51) Int. Cl.
*F42B 10/14* (2006.01)

(52) U.S. Cl.
CPC ..... *F42B 10/14* (2013.01)

(58) Field of Classification Search
CPC . F42B 10/14; F42B 10/18; B64C 3/56; B64C 2201/102; A63H 27/007
See application file for complete search history.

(56) References Cited

U.S. PATENT DOCUMENTS 3,853,288 A * 12/1974 Bode ..... F42B 10/16 244/3.29
6,571,715 B1 * 6/2003 Bennett ..... F42B 10/38 102/374
8,450,669 B2 5/2013 Roy et al.
2005/0229806 A1 * 10/2005 Johnsson ..... F42B 10/16 102/490
2007/0084961 A1 * 4/2007 Johnsson ..... F42B 10/16 244/3.28
2011/0114783 A1 * 5/2011 Roy ..... F42B 10/50 244/3.27
2016/0252333 A1 * 9/2016 Carlqvist ..... F42B 10/50 244/3.26

FOREIGN PATENT DOCUMENTS

FR 2 952 712 A1 5/2011

OTHER PUBLICATIONS

Aug. 14, 2019 Search Report and Written Opinion issued in French Patent Application No. 1872570.

* cited by examiner

*Primary Examiner* — Richard R. Green
*Assistant Examiner* — Arfan Y. Sinaki
(74) *Attorney, Agent, or Firm* — Oliff PLC

(57) ABSTRACT

A projectile including at least one pair of airfoil sections, deployable from housings located inside the body and emerging toward the outside of the projectile. The projectile includes a casing surrounding the body of the projectile and outer surface of which is in profile continuity with the body. The casing can pivot around body along longitudinal axis and includes, for each section, an opening having two zones. A first zone is indented to be positioned, by pivoting of the casing, so as to face a housing in order to allow the section to pass to allow it to be deployed, and second zone located as a recess lateral to the first zone, the recess being oriented along a direction substantially perpendicular to the first zone's longitudinal direction, the second zone having a width allowing the passage of a foot of the deployed section.

5 Claims, 6 Drawing Sheets

PROJECTILE WITH DEPLOYABLE AIRFOIL SECTIONS

BACKGROUND OF THE INVENTION

The technical field of the invention is that of projectiles including deployable airfoil sections.

It has long been known to equip projectiles with airfoil sections to increase their range, reference then being made to fins, or to be able to steer them, reference then being made to control surfaces.

Such airfoil sections, when they are folded, are arranged in housings located in the body of the projectile. A projectile of this type is described in patent FR 2,952,712.

Once the sections are deployed, the flow of air along the projectiles should be optimized so as not to disrupt or damage its aerodynamic behavior. Patent FR 2,952,712 proposes to equip the projectile with hatches at each housing opening housing a section and emerging toward the outside, and to cause them to slide in a first direction to allow the deployment of the section outside the body, then to slide the hatch back in the opposite direction to close the housing again, which leads to the problem of requiring as many motor means as there are hatches and having to control them in different rotation directions.

Also known from U.S. Pat. No. 3,853,288 is a projectile with deployable fins including a pivoting casing that surrounds the body and has the same number of openings as there are fins. Each fin includes, at its pivot, an overthickness that is defined such that, once deployed, the assembly formed by the fin and the overthickness of its pivot completely closes the opening. Such a solution is difficult to implement, since the dimensions both of the fin and its overthickness as well as the opening, must be perfectly controlled. Furthermore, the ensured closing remains imperfect, since the fin and its bulge can only close off the width of the slit of the casing and not its entire length. Lastly, this solution can only be implemented for stabilizing fins that no longer move after deployment. It is unsuitable for piloting control surfaces that have an airfoil section that pivots with respect to an axis perpendicular to the axis of the projectile.

SUMMARY OF THE INVENTION

The invention proposes a solution making it possible to simplify the process of opening and closing the housings of the airfoil sections, and in particular airfoil sections of the control surface type.

The solution proposed by the invention is independent of the fin itself, and it can therefore be adapted to fins that pivot after deployment, such as piloting control surfaces.

The invention relates to a projectile including at least one pair of airfoil sections, the airfoil sections being deployable from housings that are located inside the body and are emerging toward the outside of the projectile, the projectile including a casing of revolution surrounding at least part of the body of the projectile and the outer surface of the casing is in profile continuity with the body of the projectile, the casing being able to pivot, due to a motor means, around the body along the longitudinal axis of the body and including an opening for each section, the projectile being characterized in that each opening includes two zones, namely a first zone intended to be positioned, by the pivoting of the casing, so as to face a housing in order to allow the airfoil section to pass to allow the airfoil section to be deployed, and a second zone forming a lateral recess relative to the first zone, the recess being oriented along a direction substantially perpendicular to the longitudinal direction of the first zone, the second zone having a width allowing the passage of a foot of the airfoil section once deployed, the casing covering the housing by continuing its pivoting to prevent the folding of the airfoil section.

Advantageously, according to one embodiment, each airfoil section is deployed by pivoting around a rotation axis perpendicular to the pivoting axis of the casing.

Each second zone of the opening is then located at one end of the first zone.

According to another embodiment, each airfoil section is deployed by radial translation.

For each opening, the second zone of the opening is then located in an intermediate zone between the ends of the first zone.

BRIEF DESCRIPTION OF THE DRAWINGS

The invention will be better understood upon reading the following description, done in light of the appended drawings, in which drawings.

DETAILED DESCRIPTION OF EMBODIMENTS

Figure 1A:
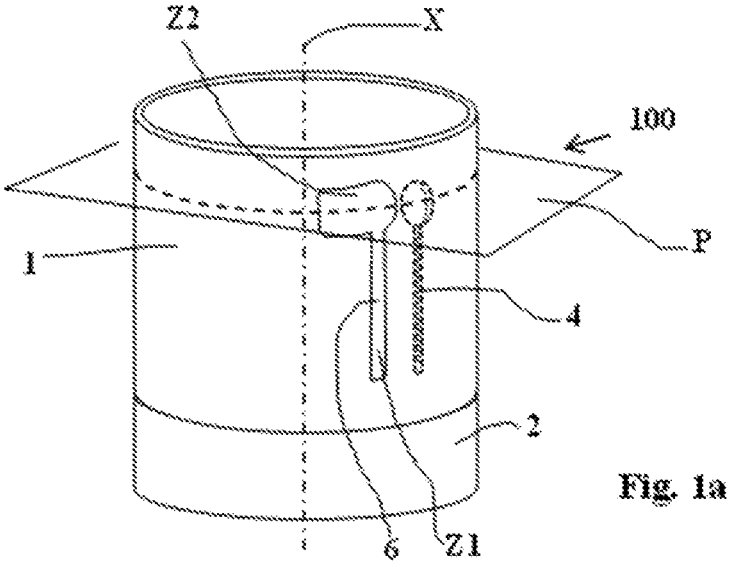
FIG. 1*a* shows a partial schematic view of part of a projectile according to a first embodiment of the invention during a first deployment phase.

According to FIG. 1*a*, a projectile 100 includes a casing 1 surrounding part of a body 2 of the projectile 100 and adopting a shape of revolution centered on the longitudinal axis X of the projectile 100. The casing 1 is thus formed by a thin-walled cylindrical cartridge that can pivot on seats (not shown) arranged on the body 2. The casing 1 is placed such that its outer surface is located in the continuity of the outer profile of the projectile 100 so as not to disrupt the aerodynamic flow during flight.

Figure 2:
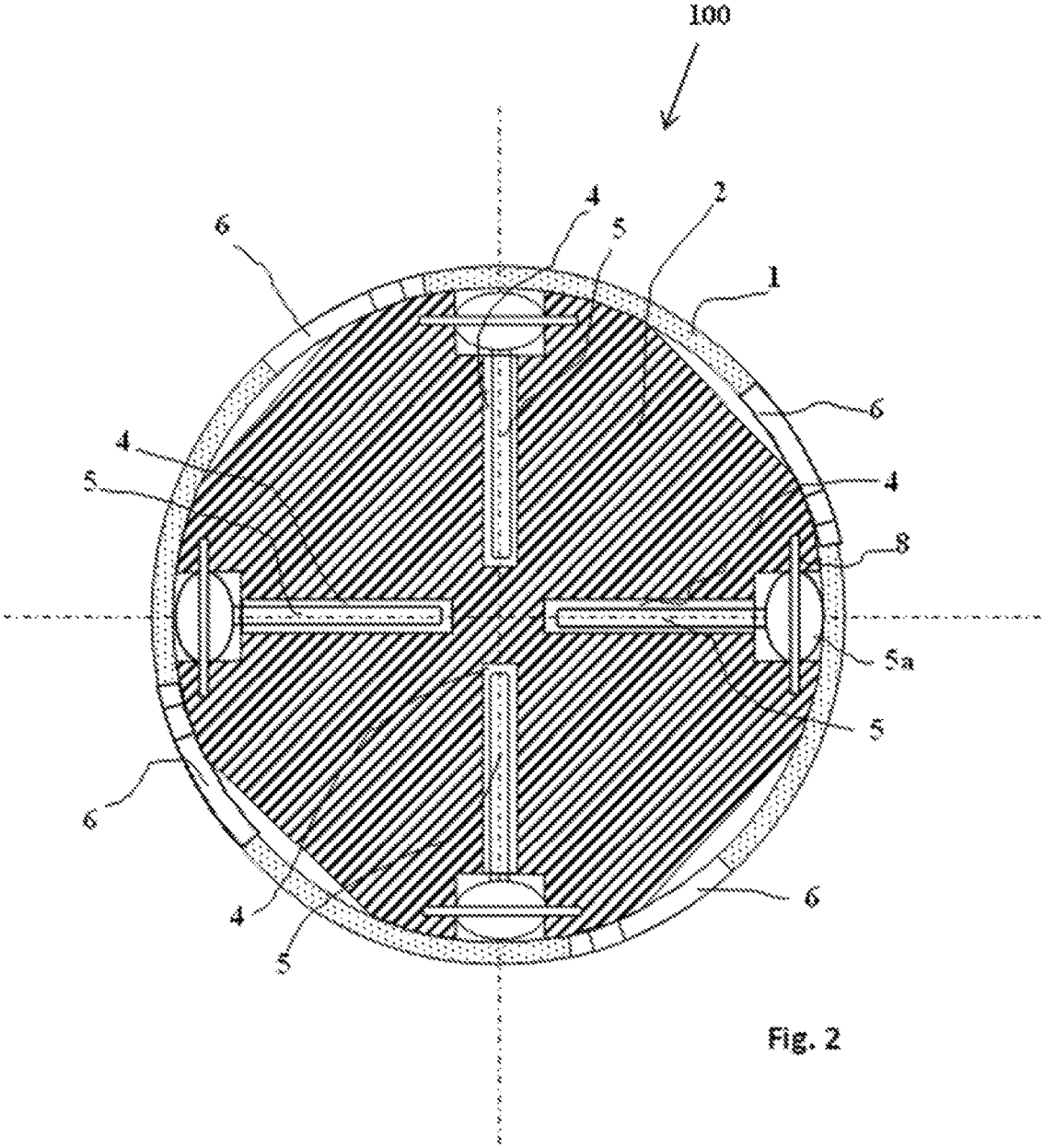
FIG. 2 shows a cross-sectional view along plane P of FIG. 1*a* of a projectile according to this first embodiment with the sections in the withdrawn position.

According to FIG. 2, the projectile 100 includes housings 4 made in the body 2 and uniformly angularly distributed.

Each housing houses an airfoil section 5 and emerges toward the outside of the projectile body 2.

In this storage position, which corresponds to a position where the sections 5 are contained in the housings 4, the casing 1 is located facing the housings 4 and prevents the sections 5 from unfolding. The sections 5 are pushed to unfold under the action of an elastic means, not shown and conventionally known by the person skilled in the art, such as a spring.

In this position, the projectile 100 can be fired, in a cannon for example, since the sections 5 are not exposed to the outside of the projectile 100. Still in FIG. 2, it will be noted that the casing 1 includes openings 6 in a number equal to that of the housings 4 and sections 5 and that are distributed angularly identically to the angular distribution of the housings 4.

Figure 1B:
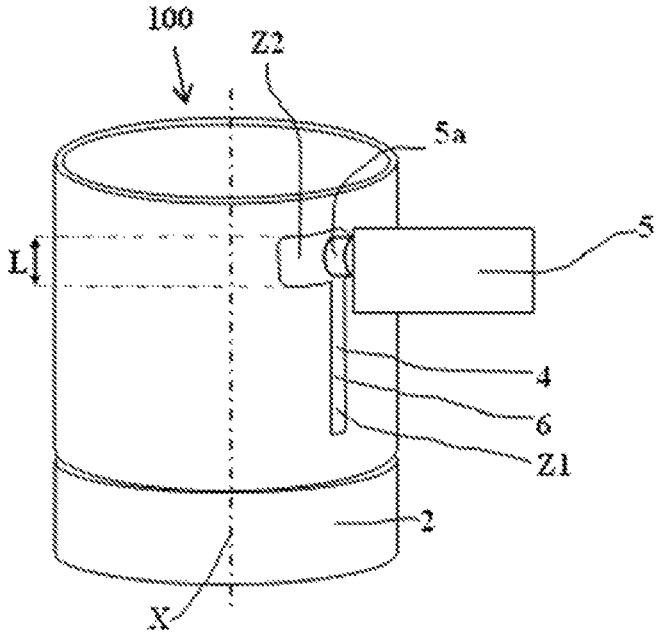
FIG. 1*b* shows a partial schematic view of part of a projectile according to this first embodiment during a second deployment phase.
Figure 1C:
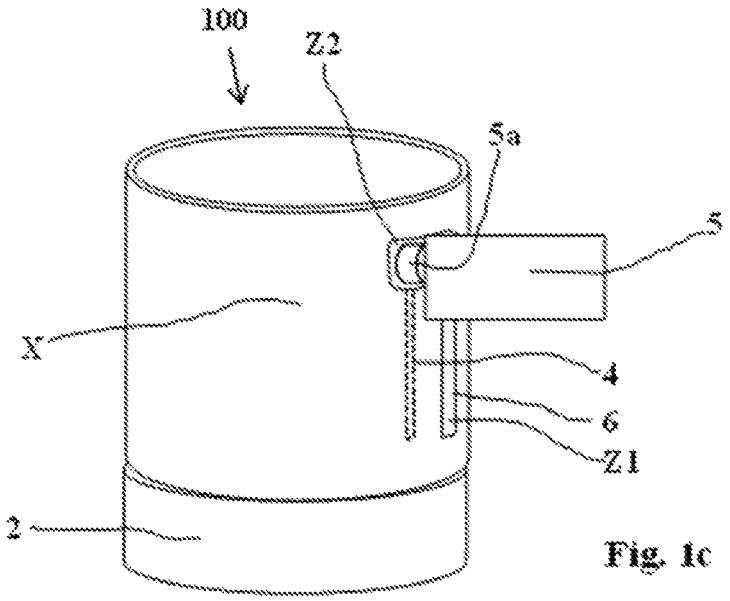
FIG. 1*c* shows a partial schematic view of part of a projectile according to this first embodiment during a third deployment phase.

As shown in FIGS. 1*a* to 1*c*, each opening 6 of the casing 1 includes two zones Z1 and Z2 each communicating with one another.

A first zone Z1 has a shape substantially corresponding to the shape of the housing 4 at which the housing 4 emerges to the outside of the body 2. A second zone Z2 forms a recess lateral to the first zone Z1, the recess being oriented along a direction substantially perpendicular to the longitudinal direction of the first zone Z1. As shown in the Figures, the width L of the second zone Z2 is much smaller than the total length of the first zone Z1. This width L corresponds to the diameter of the foot 5*a* of the airfoil section 5 (which here is a control surface able to pivot in order to pilot the projectile).

Figure 3:
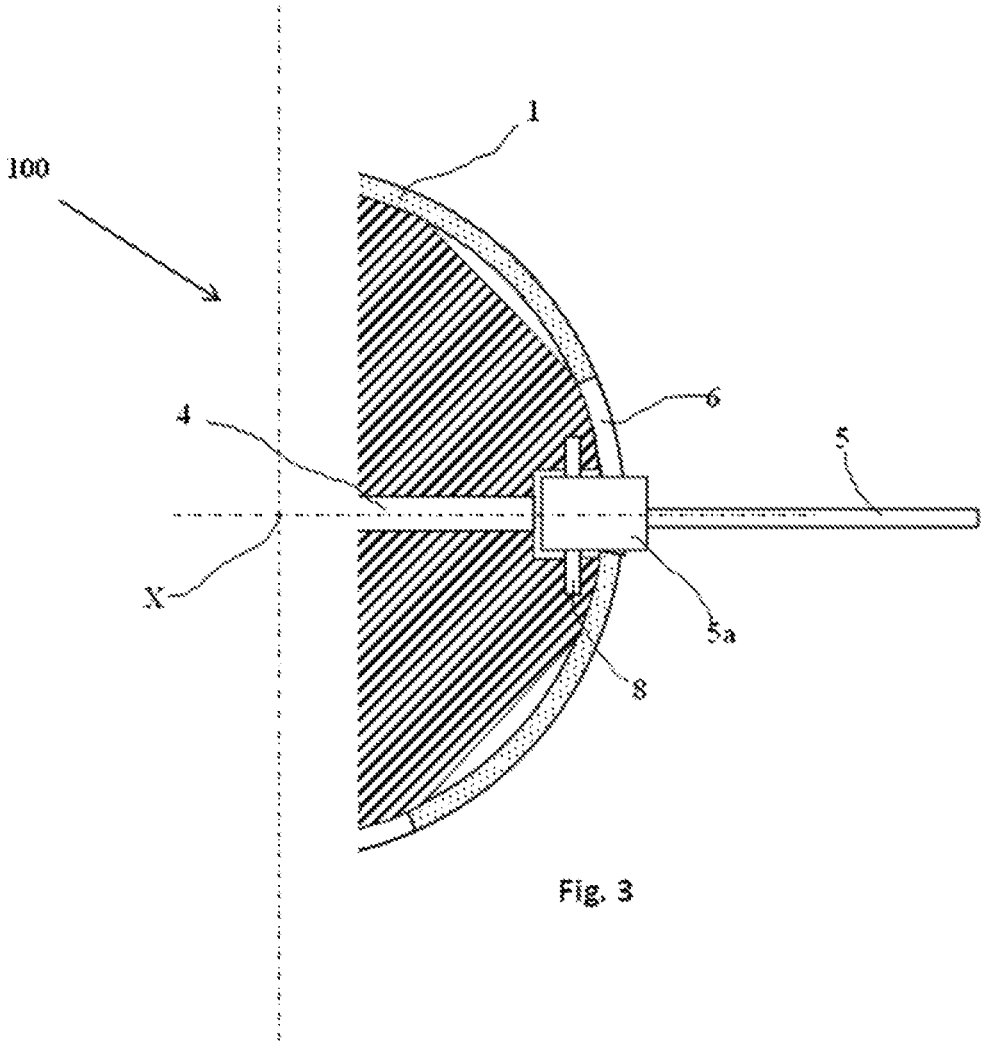
FIG. 3 shows a partial cross-sectional view of a projectile according to this first embodiment with a section in the deployed position.

According to a second operating phase of the projectile 100 visible in FIGS. 1*b* and 3 corresponding to the deployment of the sections 5, the casing 1 has pivoted angularly until, for each opening 6, each first zone Z1 is positioned facing a housing 4. Each section 5 is then no longer retained against the action of the spring by the inner wall of the casing 1. They can then be deployed to the outside of the projectile 100 by rotation around an axis 8 secured to a foot 5*a* of the airfoil section 5. The rotation axis 8 is perpendicular to the longitudinal axis X of the projectile 100.

The deployment of each section 5 is done up to a nominal position substantially radially perpendicular to the longitudinal axis X of the projectile 100. It will be noted from FIG. 1*b* that the communication of the second zone Z2 and the first zone Z1 is at an end of the first zone Z1 that faces the foot 5*a* of the unfolded airfoil section 5. The second zone Z2 thus has a width L adapted to the passage of this section 5 foot 5*a*.

Thus, according to FIGS. 1*b* and 3, when the casing 1 continues its pivoting movement around the longitudinal axis X of the projectile 100, the foot 5*a* of the section 5 positions itself in the second zone Z2.

Figure 4:
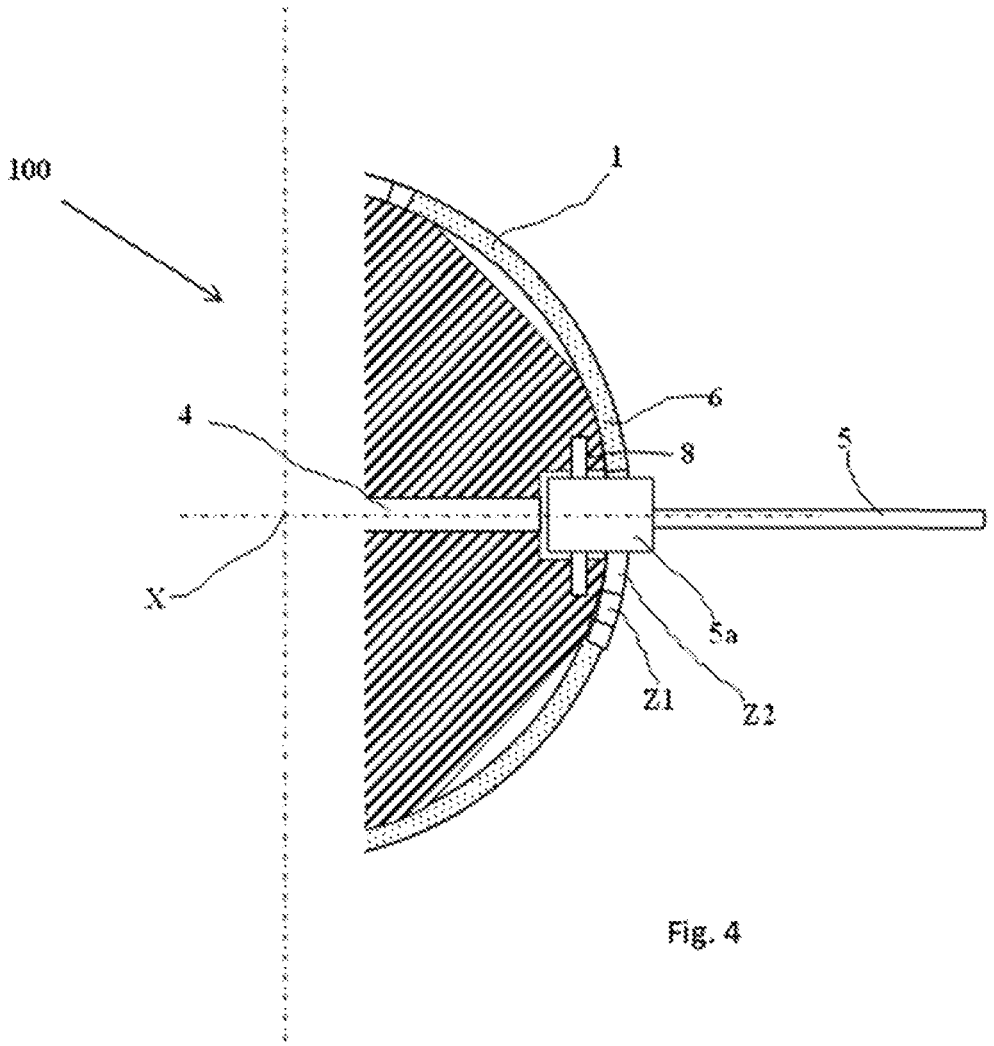
FIG. 4 shows a partial cross-sectional view of a projectile according to this first embodiment with a section in the deployed and locked position.

The pivoting of the casing 1 continues, and at the end of the pivoting of the casing 1, according to FIGS. 1*c* and 4, the casing 1 covers the housing 4 and any subsequent folding of the section 5 toward its housing 4 is prohibited by the interference of the section 5 with the casing 1. The section 5 is thus locked in the deployed position.

It will advantageously be noted that the housings 4 are closed off by the casing 1, which does not disrupt the flow of air along the projectile. Additionally, the entire locking deployment sequence is done with a rotational movement of the casing in a single angular direction, which simplifies the control, which only requires a single motor means to open all of the housings 4, in order to release all of the sections 5 and subsequently close all of the housings 4 again. The pivoting of the foot 5*a* of the airfoil section 5 is allowed by the casing 1. Indeed, the second zone Z2 surrounds the foot 5*a* of the section 5 with a clearance that is sufficient to allow such pivoting. The housings 4, however, remain closed off by the casing 1 during the pivoting of the airfoil section 5.

Figure 5A:
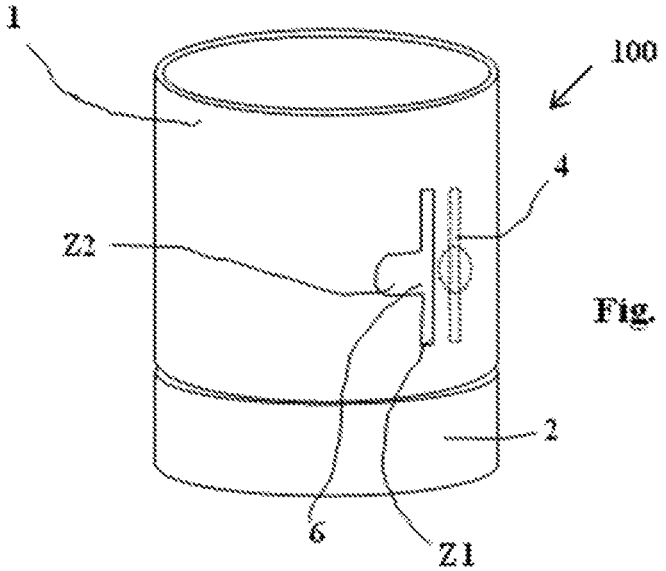
FIG. 5*a* shows a partial schematic view of part of a projectile according to a second embodiment of the invention during a first deployment phase.
Figure 5B:
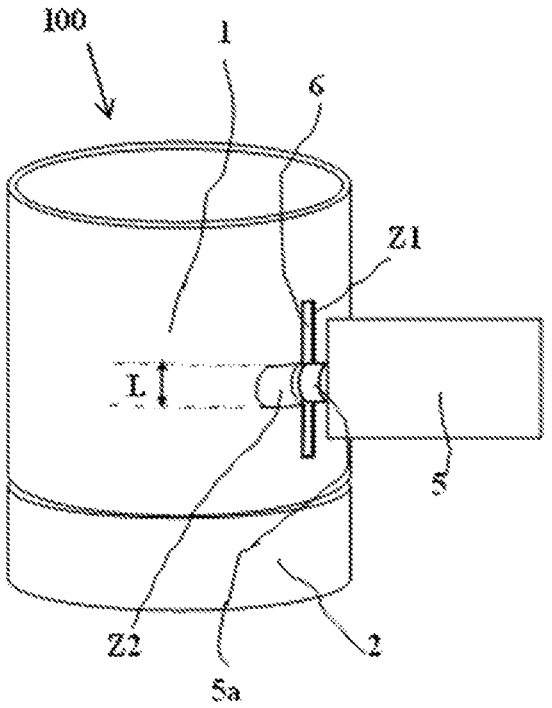
FIG. 5*b* shows a partial schematic view of part of a projectile according to this second embodiment during a second deployment phase.
Figure 5C:
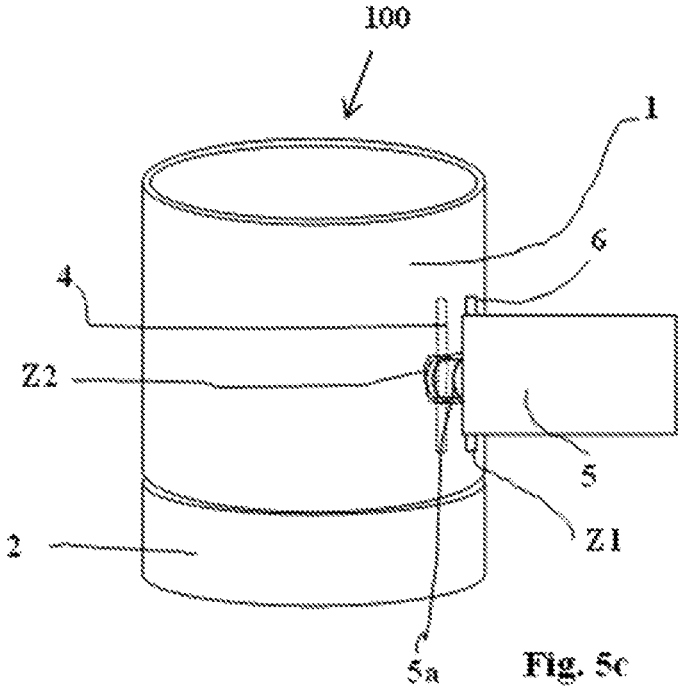
FIG. 5*c* shows a partial schematic view of part of a projectile according to this second embodiment during a third deployment phase.

FIGS. 5*a* to 5*c* show a second embodiment of the invention.

In this embodiment, the airfoil sections 5 (which are also control surfaces) are deployed by a radial translation of each section 5 in its housing 4.

The operating sequence is identical to that of the first embodiment. A single rotation of the casing 1 will open the housings 4, release the sections 5, then close the housings 4 again while locking the sections 5.

The person skilled in the art will only ensure that the second zone Z2 is positioned correctly relative to the foot 5*a* of the section 5 such that this second zone Z2 is located facing the foot 5*a* once the section 5 is deployed. The second zone Z2 of the opening will thus be located in an intermediate zone between the ends of the first zone Z1.

As an example, it will be noted that in FIGS. 5*a* to 5*c*, the foot 5*a* of the section 5 is located substantially in the middle of the base of the section 5. The second zone Z2 is then also positioned substantially in the middle of the first zone Z1 considering the longitudinal direction of the opening 6.

The invention claimed is:

1. A projectile including:

a body;

at least one pair of airfoil sections that are deployable from housings that are located inside the body and emerge toward an outside of the projectile; and a casing of revolution surrounding at least part of the body such that an outer surface of the casing is in profile continuity with the body, wherein:

the casing is able to pivot around the at least part of the body about a pivoting axis that is coincident with a longitudinal axis of the body and the casing includes an opening for each airfoil section;

each opening includes a first zone intended to be positioned, by pivoting of the casing, so as to face one of the housings in order to allow the airfoil section to pass so as to allow the airfoil section to be deployed, and a second zone forming a lateral recess relative to the first zone;

the lateral recess is oriented along a direction substantially perpendicular to a longitudinal direction of the first zone;

the second zone has a width allowing passage of a foot of the airfoil section once deployed and the second zone is positioned to receive, by continuation of the pivoting of the casing once the airfoil section is deployed, the foot of the airfoil section; and the casing covers the housing upon ending the pivoting of the casing so as to prevent folding of the airfoil section.

2. The projectile according to claim 1, wherein each airfoil section is deployed by pivoting around a rotation axis perpendicular to the pivoting axis of the casing after the casing has pivoted about the pivoting axis so as to position the first zone of each opening facing one of the housings.

3. The projectile according to claim 2, wherein the second zone of each opening is located at one end of the first zone.

4. The projectile according to claim 1, wherein each airfoil section is deployed by radial translation of the airfoil section in its housing.

5. The projectile according to claim 4, wherein the second zone of each opening is located in an intermediate zone between ends of the first zone.

* * * * *